United States Patent [19]

Linden et al.

[11] Patent Number: 4,884,840

[45] Date of Patent: Dec. 5, 1989

[54] ARRANGEMENT IN ADJUSTABLE SEATS

[75] Inventors: Ake Linden; Roger Gustafsson, both of Vetlanda, Sweden

[73] Assignee: Möbelteam AB, Sweden

[21] Appl. No.: 298,409

[22] Filed: Jan. 18, 1989

[30] Foreign Application Priority Data

Jan. 18, 1988 [SE] Sweden ..... 8800146

[51] Int. Cl.[4] ..... A47C 1/02; A47C 1/027; A47C 1/032

[52] U.S. Cl. ..... 297/320; 297/68; 297/317; 297/321

[58] Field of Search ..... 297/281, 328, 327, 326, 297/329, 316, 355, 68, 317, 318, 320, 321

[56] References Cited

U.S. PATENT DOCUMENTS

| | | | |
|---|---|---|---|
| 2,522,246 | 9/1950 | Armstrong | 297/318 |
| 3,074,759 | 1/1963 | Bergenwald | 297/320 X |
| 4,045,081 | 8/1977 | Veno | 297/317 |
| 4,383,714 | 5/1983 | Ishida | 297/68 X |
| 4,607,883 | 8/1986 | Tzu-Chun | 297/317 |

FOREIGN PATENT DOCUMENTS

| | | | |
|---|---|---|---|
| 2360855 | 6/1975 | Fed. Rep. of Germany . | |
| 145481 | 5/1954 | Sweden | 297/317 |
| 48056 | 10/1985 | Sweden . | |
| 315535 | 10/1956 | Switzerland . | |
| 636806 | 5/1950 | United Kingdom . | |

*Primary Examiner*—James T. McCall

*Attorney, Agent, or Firm*—Ostrolenk, Faber, Gerb & Soffen

[57] ABSTRACT

The invention relates to an arrangement in adjustable seats, in which a back support (1) and seat part (2) are mutually pivotably (3) joined, and where the back support (1) is pivotably (4) connected to the rear portions (5) of arm rests (7) included in the substructures (6) of the seat, and where the front portion (8) of the seat part (2) is pivotable in at least one pivot point (9) on the underside of the seat part (2), from which extends at least one slide bar (10) in the longitudinal direction of the seat part for coaction with a fixed locking sleeve (11) projecting out from the lower part of the substructure (6) for enabling an adjustment desired by the user of the mutual, angular positions of the back support (1) and seat part (2). The slide bar (10) is telescopically displaceable in its longitudinal direction, and fixable in at least two predetermined, distinct locking positions in the locking sleeve (11) projecting from the substructure (6), said sleeve having at least one hole (12) through its surface and through said hole at least one locking pin (14) can be thrust for coaction with a bore (13) in said bar when said hole is in register with said bore, for mutually locking the bar and sleeve.

8 Claims, 3 Drawing Sheets

ARRANGEMENT IN ADJUSTABLE SEATS

The present invention relates to an arrangement in adjustable seats, in which the back support and seat part are mutually pivotably joined, and where the back support is pivotably connected to the rear portions of arm rests included in the substructure of the seat, and the front portion of the seat part is pivotable at at least one pivoting point on the underside of the seat part, from which extends at least one slide bar in the longitudinal direction of the seat for coaction with a fixed locking sleeve projecting from the lower part of the substructure, for enabling an adjustment of the mutual angular positions of back support and seat part to a setting desired by the user, said slide bar being telescopically displaceable and lockable in its longitudinal direction in the locking sleeve.

Adjustable seats of the above-mentioned type are known in many different variations, in which the back support and seat part are suspended in a frame, or carried by the latter in a way such that the mentioned chief parts can be caused to assume a desired mutual angular position. Different solutions have been proposed for this, and for locking in a desired position. Several such solutions depend on friction provided by an operating wheel or lever turning a screw into engagement against a suitable abutment, enabling infinitely variable positional fixation of the back support and seat part in relation to the frame. These structures often result in that a previous user has tightened down the operating wheel so hard that a later user is unable to free it for changing the seat adjustment without the use of a special tool, or when operation is by a lever, it has been broken off, leading to subsequent repair costs. In addition, there have also been difficulties in operating the wheel or lever during adjustment of the seat.

The object of the present invention is to provide an arrangement of the kind mentioned in the introduction, which is easy to adjust and which results in the mitigation of the disadvantages in known, similar structures. The distinguishing features of the invention are disclosed in the following claims.

Due to the invention, there has now been provided an arrangement, with the aid of which adjustment of a seat can be performed readily and comfortably. Because of the perfect balancing of the seat by the attachment at pivoting points in its substructure, the mutual angular positions of back support and seat part can easily be changed to desired positions after releasing a locking device, which is actuatable by an operating means on one of the seat arm rests. There are no wheels or levers to be tightened too hard or broken due to carelessness. The operating handle is also very easily accessible, and since it is only movable a short distance between a locking and free position for a locking pin in the locking device, it is very difficult to destroy or make unserviceable by careless handling. The adjustment of the seat can be made in a plurality of fixed, closely placed locking positions providing the best comfort. There is also achieved, via telescopic function of the slide bar and locking sleeve, which regulate the seat adjustment in combination with the low-torsion, balanced attachment of the seat to the substructure, a very compact substructure with concealed slide details and very good seat balance at the same time.

The invention will now be described in more detail, and with reference to the accompanying drawing, where FIG. 1 is a schematic, partial side view of an adjustable seat in accordance with a preferred embodiment of the present invention.

Figure 1:
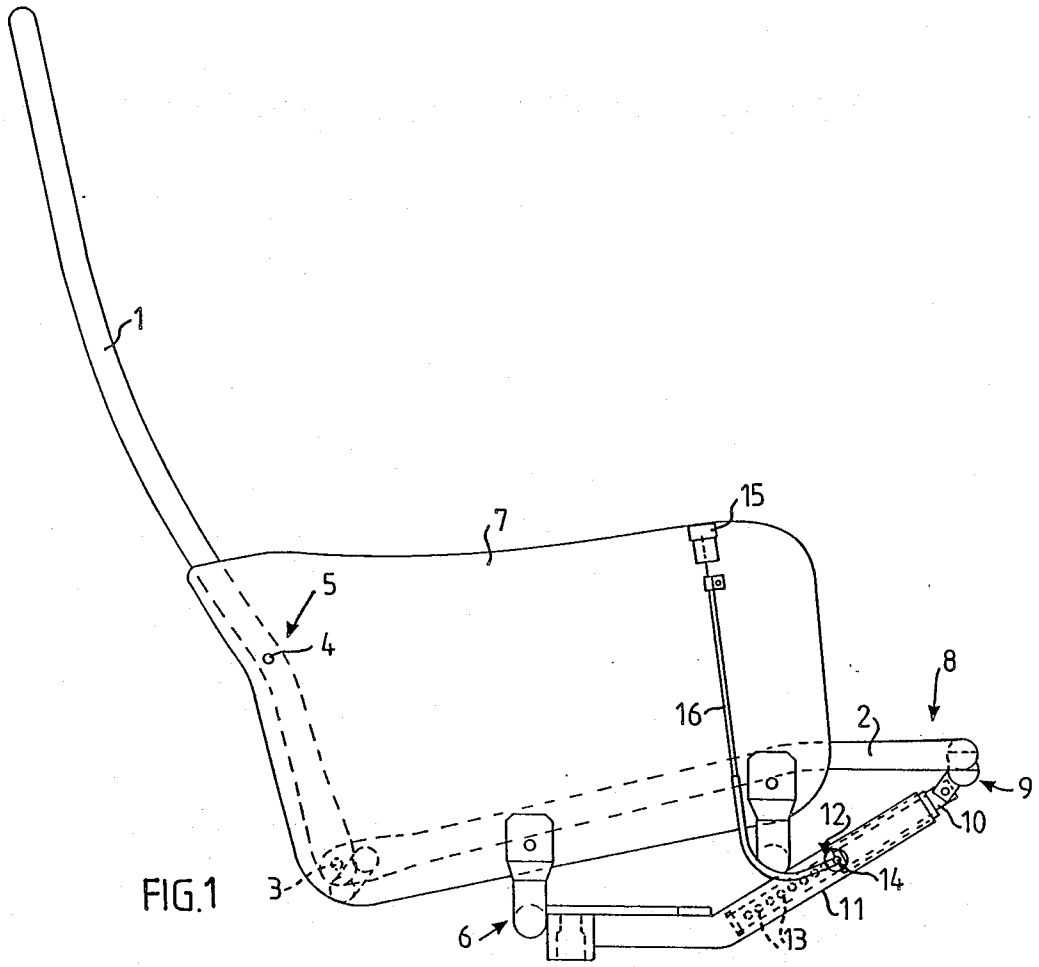
Figure 2:
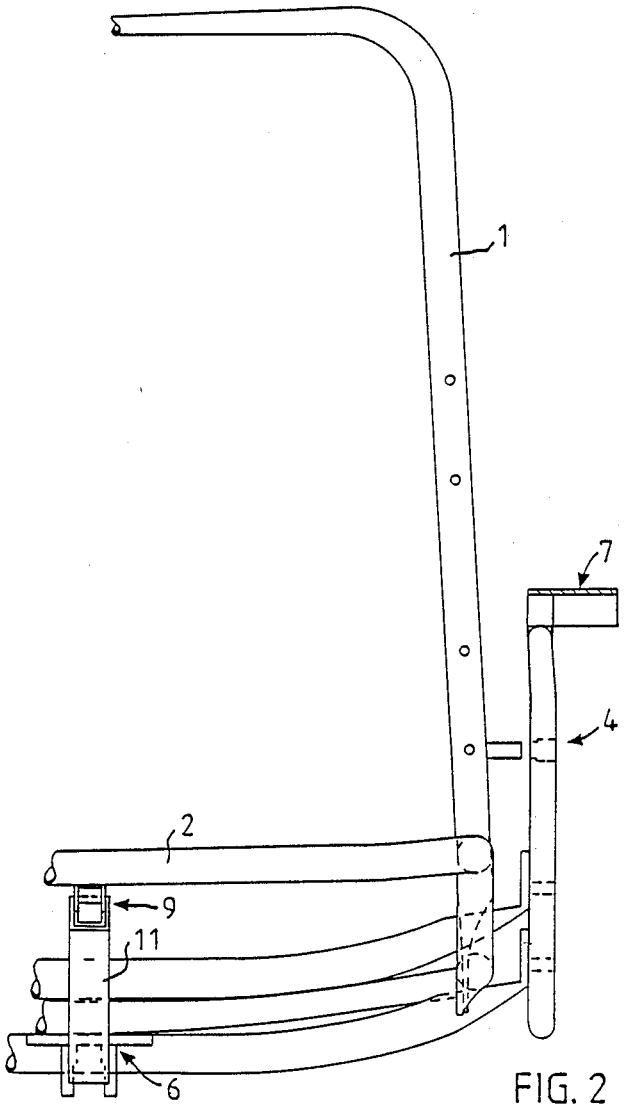
FIG. 2 is a schematic, partial front view of the seat illustrated in FIG. 1.
Figures 3, 3A, 3B:
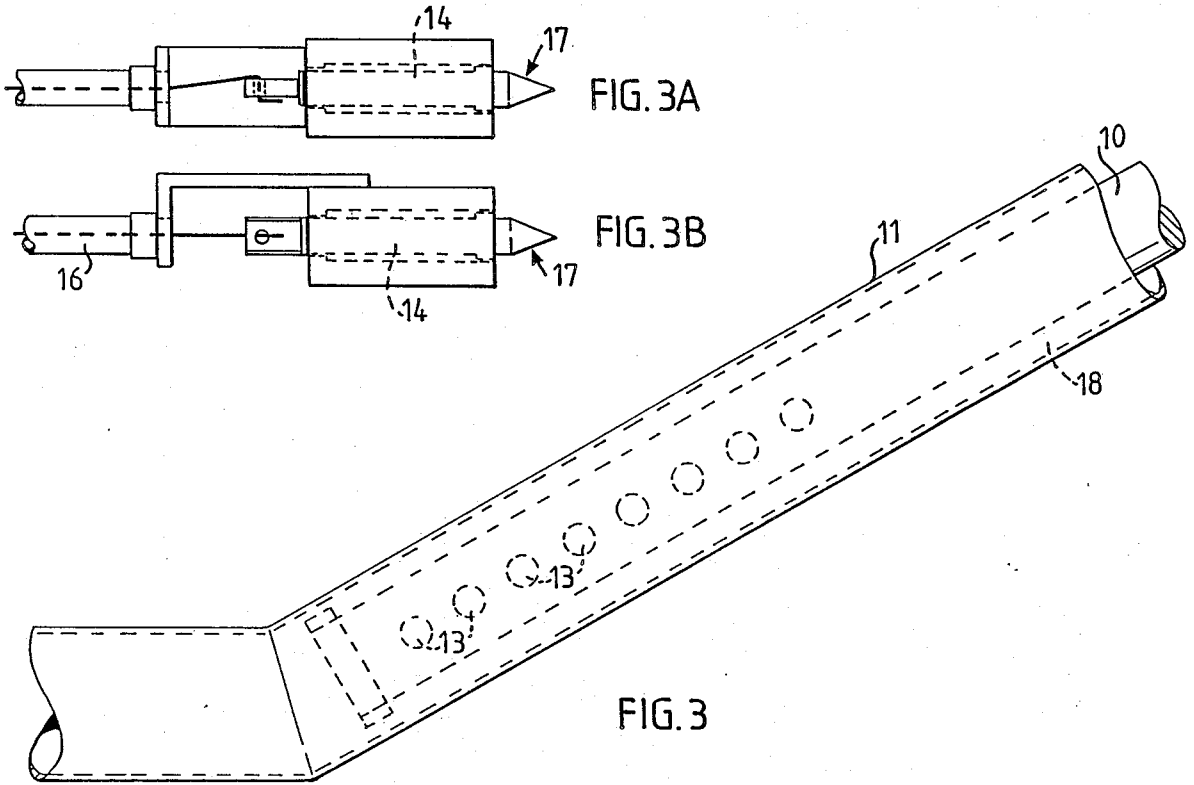
FIG. 3 is a schematic, partial side view, partly in cross section, of the seat locking device without locking pin.
FIG. 3A is a side view of a locking pin belonging to the locking device illustrated in FIG. 3
FIG. 3B is a side view of the locking pin illustrated in FIG. 3A turned 90°.

As will be seen from the drawings, a preferred embodiment of an adjustable seat in accordance with the present invention comprises a back support 1 and a seat part 2 connected pivotably to the support via a joint 3, both these chief parts being carried by a substructure or frame 6. Via joints 4 the back support is pivotably attached to the rear edge portions 5 of arm rests 7 included in the substructure 6. The front portion 8 of the seat part 2 is pivotably attached to the substructure 6 at least one pivoting point 9 on the underside of the seat part 2 via a slide bar 10. The slide bar 10 extends in the longitudinal direction of the seat part 2, towards the back support 1 and is in lockable coaction with a fixed locking sleeve 11 projecting from the lower part of the substructure 6. The bar 10 enables an angular setting of the back support 1 relative the seat part 2 by its telescopic coaction with, and displaceable location in, the locking sleeve 11, in which the bar is fixable in at least two predetermined, distinct locking positions. This is achieved by a locking pin 14, which can be inserted via a hole 12 in the surface of the sleeve 11 into a bore 13 in the bar 10 for positionally fixing the bar in relation to the sleeve 11 when the bore 13 is in register with the hole 12. The pin 14 is spring biassed towards the bar 10 in the sleeve 11, and is operable from an operating means 15 on one of the arm rests 7, with the aid of a Bowden cable 16. The fixed locking sleeve 11 projecting from the substructure preferably forms an angle to the horizontal plane attaining to approximately 30°. The free end of the locking pin 14 is tapered 17 to facilitate its entry into one of the bores 13 disposed one after the other in the bar 10. The locking pin and its hole 12 in the sleeve 11 are preferably disposed in a region, at the middle of the sleeve 11, to provide the greatest stability. The sleeve 11 is provided with a plastics bushing 18 for reducing friction between sleeve and bar. The number of bores 13 in the bar 10 for coaction with the locking pin 14 is suitably 8–12 bores, which give just as many adjusting positions of the seat.

By placing the pivoting joints 4 on the back support 1 low down in relation to the pivoting point 9 for the attachment of the slide bar 10 to the front portion of the seat part 2, there is achieved very balanced suspension of the back support 1 and seat part 2 in the substructure 6. There is then obtained a mechanical advantage with a lever action which gives very little resistance when adjusting the seat into a desired position.

We claim:

1. An adjustable seat, comprising:

a substructure, said substructure having a lower part;

arm rests attached to said substrate, said arm rests having rear portions;

a back support pivotably connected to said rear portions of said arm rests;

a seat part pivotably joined to said back support, said seat part having a front portion and an underside;

a fixed locking sleeve projecting out from said lower part of said substructure, said fixed locking sleeve having a hole through its surface;

a slide bar extending from said seat part, said slide bar being pivotably connected to said front portion of said seat part on said underside of said seat part, said slide bar being disposed in the longitudinal direction of said seat part, said slide bar being telescopically displaceable and lockable in said fixed locking sleeve in one of at least two predetermined, distinct, locking positions within said locking sleeve to adjust the mutual angular positions of said back support and said seat part to a setting desired by a user, said slide bar having a bore therein, said bore of said slide bar being registrable with said hole of said fixed locking sleeve; and a locking pin which can be thrust into said hole of said fixed locking sleeve for coaction with said bore of said slide bar when said hole is registered with said bore to lock said slide bar and said fixed locking sleeve in said one of at least two predetermined, distinct, locking positions within said locking sleeve.

2. The seat of claim 1, wherein said locking pin is spring biased toward said slide bar, said pin being actuatable from an operating means located on one of said arm rests via a Bowden cable.

3. The seat of claim 1, wherein said locking sleeve projects out from said lower part of said substructure toward said front portion of said seat part and forms an angle with the horizontal of approximately 30°.

4. The seat of claim 1, wherein said locking pin has a tapered free end for locating and locking said locking pin inside said locking sleeve.

5. The seat of claim 1, wherein said hole is located approximately in the middle of said locking sleeve for stability regardless of the adjustment of said seat.

6. The seat of claim 1, wherein said locking sleeve includes an internal plastic bushing for reducing friction between said slide bar and said sleeve.

7. The seat of claim 1, wherein said slide bar has 8–12 bores for coaction with said locking pin and said hole to provide adjustable settings of said seat.

8. The seat of claim 1, wherein said back support is pivoted to said substructure at a position which is low relative to said connection of said slide bar to said front portion of said seat part to provide mechanical advantage and reduce resistance to adjustment of said seat.

* * * * *